US009797555B2

(12) United States Patent
Chen

(10) Patent No.: US 9,797,555 B2
(45) Date of Patent: Oct. 24, 2017

(54) LED DEVICE HAVING COLLIMATOR LENS

(71) Applicant: ScienBiziP Consulting (Shenzhen) Co., Ltd., Shenzhen (CN)

(72) Inventor: Po-Chou Chen, New Taipei (TW)

(73) Assignee: ScienBiziP Consulting (Shenzhen) Co., Ltd., Shenzhen (CN)

( * ) Notice: Subject to any disclaimer, the term of this patent is extended or adjusted under 35 U.S.C. 154(b) by 311 days.

(21) Appl. No.: 14/535,492

(22) Filed: Nov. 7, 2014

(65) Prior Publication Data

US 2015/0276151 A1 Oct. 1, 2015

(30) Foreign Application Priority Data

Mar. 26, 2014 (TW) ..... 103111342 A

(51) Int. Cl.

| | |
|---|---|
| ***F21V 13/00*** | (2006.01) |
| ***F21K 99/00*** | (2016.01) |
| ***F21V 5/04*** | (2006.01) |
| *F21V 9/16* | (2006.01) |
| *F21Y 115/10* | (2016.01) |

(52) U.S. Cl.

CPC ..... *F21K 9/56* (2013.01); *F21V 5/045* (2013.01); *F21V 9/16* (2013.01); *F21Y 2115/10* (2016.08)

(58) Field of Classification Search

CPC ..... F21V 5/045; F21V 9/16; F21Y 2101/00

USPC ..... 362/242, 97.1–97.4

See application file for complete search history.

(56) References Cited

U.S. PATENT DOCUMENTS

| | | | | |
|---|---|---|---|---|
| 2002/0150722 | A1* | 10/2002 | Suzuki | C08J 7/04 428/141 |
| 2007/0035679 | A1* | 2/2007 | Lee | G02F 1/133603 349/58 |
| 2010/0238648 | A1* | 9/2010 | Tsukahara | G02B 6/005 362/97.1 |
| 2013/0010454 | A1* | 1/2013 | Takayama | F21V 5/045 362/84 |

OTHER PUBLICATIONS

"Fresnel Lenses" Fresnel Technologies, Inc. 1996-2014.*

* cited by examiner

*Primary Examiner* — Elmito Breval
*Assistant Examiner* — Naomi M Wolford
(74) *Attorney, Agent, or Firm* — Steven Reiss

(57) ABSTRACT

An LED device includes a plurality of LED dies, a plurality of lens, a diffuser plate and a collimator lens. The collimator lens is positioned between the diffuser plate and the lens. The collimator lens includes a plurality of fresnel lenses. A focus of each fresnel lens is equal to a distance between a plane where the fresnel lens places and a light outputting surface of the LED die. Light emitted from the LED dies is adjusted to collimator light and striking perpendicularly into the diffuser plate.

14 Claims, 2 Drawing Sheets

LED DEVICE HAVING COLLIMATOR LENS

FIELD

The disclosure relates to LED (light emitting diode) devices, and particularly to LED devices with a collimator lens.

BACKGROUND

An LED device for a back light module typically includes a plurality of LED dies and a fluorescent layer covering the LED dies to obtain a surface light source. The LED die usually has a light output angle about 120°, which has an uneven distribution of light field with high light intensity at center thereof and low light intensity at periphery thereof. Therefore, a diffuser plate is always applied to increase the light output angle and distribute the light evenly at center and at periphery thereof. However, the diffuser plate which has a high diffusion capability also has a poor penetration capability. While traveling in the diffuser plate, more light emitted from the LED die will be absorbed. Thus, a luminous efficiency of the LED device will be reduced when the light emitted from the LED die travels in the diffuser plate and is reflected again and again therein and is partially absorbed by the diffuser plate.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED device having a collimator lens. Moreover, in the drawings, like reference numerals designate corresponding parts throughout the views.

DETAILED DESCRIPTION

Reference will now be made to the drawings to describe the present LED device having a collimator lens, in detail.

Figure 1:
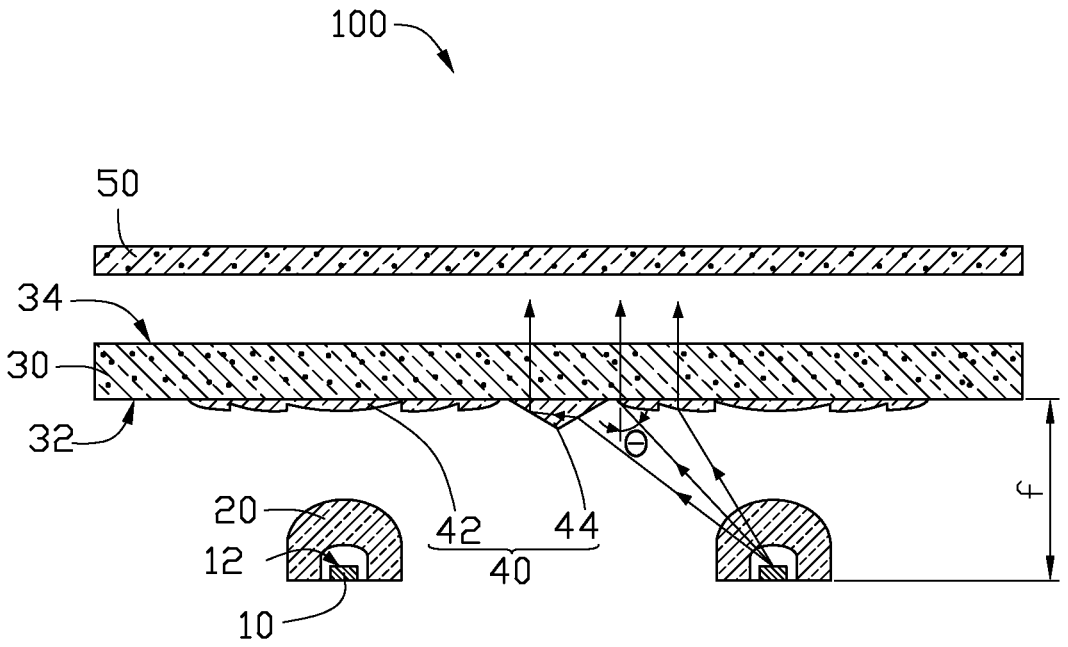
FIG. 1 is a cross-sectional view of an LED device in accordance with an exemplary embodiment of the present disclosure.

Referring to FIG. 1, an LED device 100 includes a plurality of LED dies 10, a plurality of lenses 20, a diffuser plate 30, a collimator lens 40, and a fluorescent layer 50.

Each lens 20 is positioned over an LED die 10 and covers the LED die 10. In this embodiment, each LED die 10 can be a blue die or a near-ultraviolet die. Each LED die 10 has a light outputting surface 12 facing the corresponding lens 20. Light emitting from the LED die 10 travels through the lens 20 and is deflected by the lens 20 to diffuse with a single wavelength. The diffused light has an angle larger than 120 degrees. As such, light intensity between neighboring LED dies 10 are enhanced, thereby a distance between neighboring LED dies 10 can be increased and less LED dies 10 are required.

The diffuser plate 30 is positioned to face the light outputting surface 12 of the LED dies 10. The diffuser plate 30 is made of transparent organic resin, such as polymethyl methacrylate (PMMA) or polycarbonate (PC). Light scattering particles are diffused in the diffuser plate 30 to further distribute the light striking into the diffuser plate 30 evenly. The diffuser plate 30 is substantially plate shaped. The diffuser plate 30 includes a light inputting surface 32 and a light outputting surface 34. The light emitting from the LED die 10 enters the diffuser plate 30 through the light inputting surface 32. The light strikes on the light inputting surface 32 and is reflected/refracted to be distributed evenly by the light scattering particles when traveling in the diffuser plate 30, and then penetrates out of the light outputting surface 34.

Figure 2:
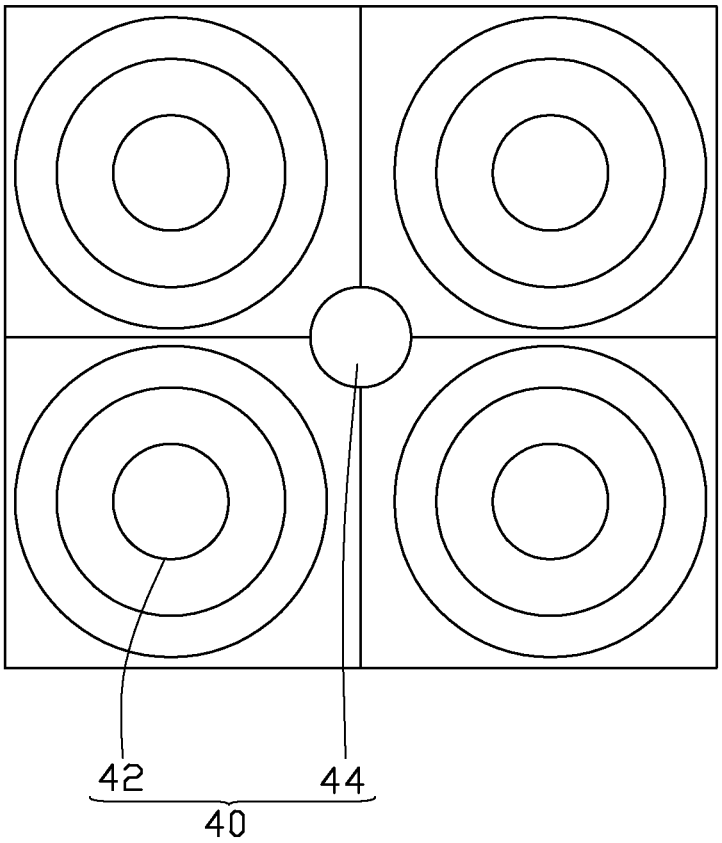
FIG. 2 is a top view of a collimator lens used in the LED device shown in FIG. 1.

Also referring to FIG. 2, the collimator lens 40 is positioned between the diffuser plate 30 and the lens 20. In this embodiment, the collimator lens 40 is attached on the inputting surface 32 of the diffuser plate 30. The collimator lens 40 is used for adjusting the light striking on the collimator lens 40 and permitting the light to distribute in the diffuser plate 30. The collimator lens 40 can adjust the light emitted from the LED dies 10 with different incident angles to collimator light perpendicular to the diffuser plate 30. The collimator lens 40 includes at least two fresnel lenses 42 and at least one prism 44. One prism 44 is positioned between each two neighboring fresnel lenses 42. The number of the fresnel lenses 42 is the same as that of the LED dies 10. The fresnel lenses 42 are arranged in a matrix. Each four neighboring fresnel lenses 42 form a matrix unit, and the four neighboring fresnel lenses 42 in one matrix unit together surround one prism 44.

Each fresnel lens 42 faces a corresponding LED die 10. A focus of each fresnel lens 42 is equal to a distance between a plane where the fresnel lens 42 places and the light outputting surface 12 of the LED die 10. Most light is adjusted to collimator light and strikes perpendicularly into the diffuser plate 30 when the light emitted from the LED dies 10 is incident into the fresnel lenses 42. Benefiting from the collimator light, light path which the light travels in the diffuser plate 30 will be shorter and less light will be absorbed by the diffuser plate 30. Thus, the luminous efficiency of the LED device will be increased while the diffusion capability of the diffuser plate 30 is not decreased. In the present disclosure, an area of each fresnel lens 42 is smaller than or equal to that of a light field formed by the light emitted from each LED die 10 striking on the diffuser plate 30. Each fresnel lens 42 is used for receiving the light emitted from a corresponding LED die, which will be good for the even distribution of the LED dies 10 and obtaining even outputting light. An angle $\theta$ is defined as the largest angle the light has when the light is emitted from each LED die 10 and then refracted by the lens 20. The plane where the fresnel lenses 42 are placed is substantially the light inputting surface 32 of the diffuser plate 30, and is equal to the focus F of each fresnel lens 42. The area of each fresnel lens 42 is smaller than or equal to $\pi(f \cdot \tan\theta)^2$.

Each prism 44 is positioned between two neighboring fresnel lenses 42 to receive the light having larger incident angle than that of the light striking on the fresnel lenses 42 when the light strikes on the collimator lens 40. Each prism 44 has a profile as an isosceles cone. An outer surface of each prism 44 is a light incident surface, and an inner surface of each prism 44 is a total reflection surface. The light striking on each prism 44 will penetrate in the prism 44 and be reflected totally by the inner surface of the prism 44 into collimator light perpendicular to the diffuser plate 30. The luminous efficiency of the LED device will be more increased due to the light having large incident angle is also adjusted as collimator light by the prisms 44 and strikes perpendicularly onto the diffuser plate 30. Referring to FIG. 2, each four neighboring Fresnel lenses 42 forms a matrix unit. Each prism 42 is surrounded by the four neighboring Fresnel lenses 42 of one matrix unit to receive the light having larger incident angle than that of the light striking on the Fresnel lenses 42.

The fluorescent layer 50 has yellow phosphor powder evenly dropped therein. The light emitted from the blue LED dies 10 can be excited and mixed in the fluorescent layer 50 to obtain a white light.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An LED device, comprising:

a plurality of LED dies;

a plurality of lenses each covering a corresponding LED die;

a diffuser plate; and a collimator lens positioned between the diffuser plate and the lens, the collimator lens comprising a plurality of Fresnel lenses arranged in a matrix and at least a prism, a focus of each Fresnel lens being equal to a distance between a plane where the Fresnel lenses are placed and a light outputting surface of the LED die, light emitted from the LED dies being collimated into collimator light and striking perpendicularly into the diffuser plate, each four neighboring Fresnel lenses forming a matrix unit, each prism being surrounded by the four neighboring Fresnel lenses of one matrix unit to receive the light having a larger incident angle than the incident angle of the light striking on the Fresnel lenses when the light strikes on the collimator lens.

2. The LED device of claim 1, wherein the diffuser plate comprises a light inputting surface and a light outputting surface, and the Fresnel lenses are attached on the light inputting surface.

3. The LED device of claim 1, wherein an area of each Fresnel lens is smaller than or equal to $\pi(f \cdot \tan\theta)^2$, wherein $\theta$ is defined as a largest angle the light has when the light is emitted from each LED die and then refracted by the corresponding lens, and f is equal to the focus of each Fresnel lens.

4. The LED device of claim 1, wherein each Fresnel lens faces a corresponding LED die to receive light emitted from the LED die.

5. The LED device of claim 1, wherein each prism has a profile as an isosceles cone.

6. The LED device of claim 1, wherein an inner surface of each prism is a total reflection surface.

7. The LED device of claim 1 further comprising a fluorescent layer, wherein the fluorescent layer has yellow phosphor powder evenly dropped therein, and the LED dies are blue dies.

8. The LED device of claim 1, wherein light scattering particles are diffused in the diffuser plate to distribute the light striking into the diffuser plate.

9. An LED device, comprising:

a plurality of LED dies each having a light outputting surface;

a plurality of lenses each covering a corresponding LED die;

a diffuser plate comprising a light inputting surface and a light outputting surface;

a plurality of Fresnel lenses positioned on the diffuser plate and arranged in a matrix, a focus of each Fresnel lens being equal to a distance between the light inputting surface of the diffuser plate and the light outputting surface of the LED die, light emitted from the LED dies being collimated into collimator light and striking perpendicularly into the diffuser plate, each four neighboring Fresnel lenses forming a matrix unit; and at least one prism, each prism being surrounded by the four neighboring Fresnel lenses of one matrix unit to receive the light having a larger incident angle than the incident angle of the light striking on the Fresnel lenses.

10. The LED device of claim 9, wherein the Fresnel lenses are attached on the light inputting surface.

11. The LED device of claim 9, wherein an area of each Fresnel lens is smaller than or equal to $\pi(f \cdot \tan\theta)^2$, wherein $\theta$ is defined as a largest angle the light has when the light is emitted from each LED die and then refracted by the corresponding lens, and f is equal to the focus of each Fresnel lens.

12. The LED device of claim 9, wherein each Fresnel lens faces a corresponding LED die to receive most light emitted from the LED die.

13. The LED device of claim 9, wherein each prism has a profile as an isosceles cone.

14. The LED device of claim 9, wherein an inner surface of each prism is a total reflection surface.

* * * * *